US006047151A

United States Patent [19]

Carvalho et al.

[11] Patent Number: 6,047,151

[45] Date of Patent: Apr. 4, 2000

[54] DRYING SYSTEM AND METHOD FOR AN ELECTROPHOTOGRAPHIC IMAGING SYSTEM

[75] Inventors: Marcio da Silveira Carvalho, Rio de Janeiro, Brazil; William Blake Kolb, St. Paul, Minn.; Kay F. Schilli, Portland, Oreg.

[73] Assignee: Imation Corp., Oakdale, Minn.

[21] Appl. No.: 09/073,515

[22] Filed: May 6, 1998

[51] Int. Cl.[7] ..... G03G 15/10

[52] U.S. Cl. ..... 399/250; 34/469; 34/659

[58] Field of Search ..... 399/250, 251; 118/61; 34/419–422, 468, 469, 75, 659, 73

[56] References Cited

U.S. PATENT DOCUMENTS

| | | | |
|---|---|---|---|
| 3,158,509 | 11/1964 | Hudson . | |
| 3,767,300 | 10/1973 | Brown et al. | 399/250 |
| 3,893,245 | 7/1975 | Knechtel et al. | 34/95 |
| 4,142,301 | 3/1979 | Goodall | 34/18 |
| 4,365,423 | 12/1982 | Arter et al. | 34/23 |
| 4,462,675 | 7/1984 | Moraw et al. | 399/250 |
| 4,538,899 | 9/1985 | Landa et al. | 399/156 |
| 4,999,927 | 3/1991 | Durst et al. | 34/23 |
| 5,077,912 | 1/1992 | Ogawa et al. | 34/23 |
| 5,177,877 | 1/1993 | Duchesne et al. . | |
| 5,414,498 | 5/1995 | Buchan et al. . | |
| 5,420,675 | 5/1995 | Thompson et al. | 355/256 |
| 5,481,341 | 1/1996 | Sypula et al. . | |
| 5,552,869 | 9/1996 | Schilli et al. | 355/256 |
| 5,581,905 | 12/1996 | Huelsman et al. | 34/421 |
| 5,652,282 | 7/1997 | Baker et al. | 523/201 |
| 5,694,701 | 12/1997 | Huelsman et al. | 34/421 |
| 5,737,674 | 4/1998 | Venkatesan et al. | 399/250 |
| 5,841,456 | 11/1998 | Takei et al. | 347/103 |

FOREIGN PATENT DOCUMENTS

| | | | |
|---|---|---|---|
| 1401041 | 7/1975 | Austria | B01D 5/00 |
| 55-050287 | 4/1980 | Japan . | |
| 4-156468 | 5/1992 | Japan . | |

OTHER PUBLICATIONS

Cohen, Edward et al., "Modern Coating and Drying Technology", pp. 267–302 (1992).

Mujumdar, Arun S., "Drying '80", vol. 2, pp. 485–494.

*Primary Examiner*—Robert Beatty

*Attorney, Agent, or Firm*—William K. Weimer

[57] ABSTRACT

A drying system and method for an electrophotographic imaging system employing a gap drying system. The electrophotographic imaging system includes a photoconductor belt. A mechanism moves the photoconductor belt in a first direction along a transport path. A scanner mechanism is positioned along the transport path for scanning a laser beam along the photoconductor belt based on image data to form a latent image of the photoconductor belt. A development station is positioned along the transport path. The development station includes a mechanism for applying a toner to a first major surface of the photoconductor belt, the toner including a carrier liquid. A gap drying system is operably located along the transport path, wherein the gap drying system removes excess carrier liquid from the photoconductor belt. The gap drying system includes a carrier liquid (i.e., solvent) vapor recovery system which is integral the gap drying system, and as such, the electrophotographic imaging system does not require an additional separate carrier liquid recovery/condenser unit.

34 Claims, 4 Drawing Sheets

DRYING SYSTEM AND METHOD FOR AN ELECTROPHOTOGRAPHIC IMAGING SYSTEM

TECHNICAL FIELD

The present invention relates to electrophotographic imaging systems, and more particularly, to an electrophotographic imaging system and method employing a gap drying system to remove excess carrier liquid from a photoconductor belt before transferring a developed image to an intermediate transfer roll or output substrate. Inherent in the gap drying system is a solvent recovery process.

BACKGROUND OF THE INVENTION

In multi-color electrophotographic imaging systems, latent images are formed in an imaging region of a moving photoconductor (e.g., an organic photoreceptor) belt. Each of the latent images is representative of one of a plurality of different color separation images. The color separation images together define an overall multi-color image. The color separation images may define, for example, yellow, magenta, cyan, and black components that, upon subtractive combination on output media, produce a representation of the multi-color image.

Each of the latent images is formed by scanning a modulated laser beam across the moving photoconductor to selectively discharge the photoconductor in an image-wise pattern. Appropriate liquid color developers (i.e., toners) are applied to the photoconductor after each latent image is formed to develop the latent images. The resulting color separation images ultimately are transferred to the output media or substrate to form the multi-color image.

In some electrophotographic imaging systems, the latent images are formed and developed on top of one another in a common imaging region of the photoconductor. The latent images can be formed and developed in multiple passes of the photoconductor around a continuous transport path (i.e., a multi-pass system). Alternatively, the latent images can be formed and developed in a single pass of the photoconductor around the continuous transport path. A single-pass system enables the multi-color images to be assembled at extremely high speeds relative to the multi-pass pass system. An example of an electrophotographic imaging system configured to assemble a multi-color image in a single pass of a photoconductor is disclosed in co-pending U.S. patent application Ser. No. 08/537,296 to Kellie et al., filed Sep. 29, 1995, and entitled "Method and Apparatus For Producing A Multi-Colored Image In An Electrophotographic System". At each color development station, liquid color developers are applied to the photoconductor belt, for example, by electrically biased rotating developer rolls. The colored liquid developer (or toner) is made of small colored pigment particles dispersed in an insulating liquid (i.e., a carrier liquid).

Excess carrier liquid deposited on the photoconductor belt may stain and smudge the image, and/or cause problems in transferring the image to the transfer roll or output substrate. As such, a liquid removal mechanism such as a squeegee roll may be used immediately after each developer roll to remove excess carrier liquid deposited on the photoconductor belt at each color station. However, before the developed image is transferred to an output substrate, further drying of the image is typically required to remove all (or most all of) any remaining carrier liquid.

Most carrier liquid removal systems or heat based drying systems generate solvent vapors which could be harmful and/or create odors if allowed to be released from the imaging system. As carrier liquid is removed from the photoconductor belt, corresponding solvent vapors must be kept from escaping out of the printer into the ambient air. Separate recovery systems must be used to recover and recycle the solvent in a liquid form. Additionally, most electrophotographic imaging systems include filter systems (e.g., carbon filters) capable of recovery of small amounts of the solvent vapor.

U.S. Pat. No. 5,420,675 to Thompson et al. teaches a drying system that uses a film forming drying roll. The drying roll is in contact with the imaged side of the photoconductor belt. The film forming drying roll has a thin, outer layer which is carrier liquid-phillic and an inner layer which is carrier liquid-phobic and compliant. As the drying roller contacts the photoconductor during the electrophotographic process, the carrier liquid entrains in the carrier liquid-phillic layer and is later removed from it by heating the liquid to a temperature greater than the flash point of the carrier liquid.

U.S. Pat. No. 5,552,869 to Schilli et al. discloses a drying method and apparatus for electrophotography using liquid toners. The drying apparatus removes excess carrier liquid from an image produced by liquid electrophotography on a moving photoreceptor belt. The system includes a drying roll that contacts the photoconductor, with an outer layer that absorbs and desorbes the carrier liquid and an inner layer having a Shore A hardness of 10 to 60 which is carrier liquid-phobic, and a heating means to increase the temperature of the drying roll to no more than 5° Celsius below the flash point of the carrier liquid. In one embodiment, the heating means includes two hot rolls and the system further includes a cooling means which cools the drying roll.

For each of the aforementioned patent references, a separate carrier liquid (i.e., solvent) recovery system is required to remove carrier liquid vapor from the air as it is released during the drying process. As such, a separate carrier liquid recovery condenser unit must be installed adjacent to the drying system.

SUMMARY OF THE INVENTION

In one embodiment, the present invention provides an electrophotographic imaging system employing a gap drying system. The electrophotographic imaging system includes a photoconductor belt. A mechanism is provided for moving the photoconductor belt in a first direction along a transport path. A scanner mechanism is positioned along the transport path for scanning a laser beam across the photoconductor belt based on image data to form a latent image on the photoconductor belt. A development station is positioned along the transport path. The development station includes a mechanism for applying a toner to a first major surface of the photoconductor belt, the toner including a carrier liquid. A gap drying system is operably located along the transport path. The gap drying system removes excess carrier liquid from the photoreceptor belt.

The gap drying system further includes means for recovering carrier liquid, wherein the means for recovering carrier liquid is integral the gap drying system. The development station may include a carrier liquid removal mechanism, wherein the carrier liquid removal mechanism removes excess carrier liquid from the photoconductor belt. In one application, the carrier liquid removal mechanism includes a squeegee roll. In another application, the carrier liquid removal mechanism includes a drying roll. In yet another application, the carrier liquid removal mechanism includes a separate development station gap drying system.

A carrier liquid collector mechanism may be provided in fluid communication with the gap drying system. Further, a second gap drying system may also be operably positioned along the transport path.

The gap drying system may include a condensing surface spaced adjacent the photoconductor belt, facing the first major surface of the photoconductor belt. Means are provided for evaporating the excess carrier liquid from the photoconductor belt to create a vapor. Means are provided for transporting the vapor to the condensing surface. Means are provided for condensing the vapor on the condensing surface to create a condensate. Means are provided for removing the condensate from the condensing surface such that the condensate does not drop onto the first major surface. In one embodiment, the means for evaporating the excess carrier liquid from the photoconductor belt comprises means for supplying energy to the substrate without applied convection.

In one aspect, the system includes a condensing platen located adjacent the first major surface of the photoconductor belt, wherein the condensing surface is part of the condensing platen, and a heated platen facing a second major surface of the photoconductor belt, wherein the heated platen is part of the means for evaporating the excess carrier liquid from the photoconductor belt.

In another embodiment, the present invention provides a drying and carrier liquid recovery system for removing excess carrier liquid from a first major surface of a photoconductor. The drying and carrier liquid recovery system includes a first gap drying system including a condensing surface facing the first major surface of the photoreceptor. Means are provided for evaporating the excess carrier liquid to create a vapor. Means are provided for transporting and condensing the vapor on the condensing surface to create a condensate. Means are provided for removing the condensate from the condensing surface to a collection location.

Additionally, a carrier liquid removal mechanism may be provided. The carrier liquid removal mechanism may include a squeegee roller which is loaded against first major surface. The carrier liquid removal mechanism may be heated. In one embodiment, the liquid removal mechanism includes at least one heated roller which contacts a second major surface of the photoconductor belt. Alternatively, a second gap drying system may be operably positioned along the photoconductor belt similar to the first gap drying system.

The drying and carrier liquid recovery system may further include a condensing platen located adjacent the first major surface of the photoconductor belt. The condensing surface is part of the condensing platen. A heated platen faces the second major surface of the photoconductor belt, wherein the heated platen is part of the means for evaporating the excess carrier liquid from the photoconductor belt. In one aspect, the photoconductor is moving, and the means for removing moves the condensate in a direction substantially transverse to the direction of movement of the photoconductor belt.

In another embodiment, the present invention provides a method of forming a latent image on a photoconductor belt using an electrophotographic imaging system. The method includes the step of providing a photoconductor belt. The photoconductor belt is moved in a first direction along a continuous transport path. A laser beam is scanned across the photoconductor belt based on image data to form a latent image the photoconductor belt. The latent image is formed on the photoconductor belt, including applying a toner to a first major surface of the photoconductor belt, the toner including a carrier liquid. A gap drying system is operably located along the photoconductor belt. Excess carrier liquid is removed from the photoconductor belt using the gap drying system.

A carrier liquid recovery system may be operably positioned along the transport path. Excess carrier liquid may be removed from the photoconductor belt using the carrier liquid recovery system after applying toner to the first major surface of the photoconductor belt. The step of providing a carrier liquid recovery system may include the step of positioning a squeegee roller adjacent the photoconductor belt is loaded against the first major surface.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION

Figure 1:
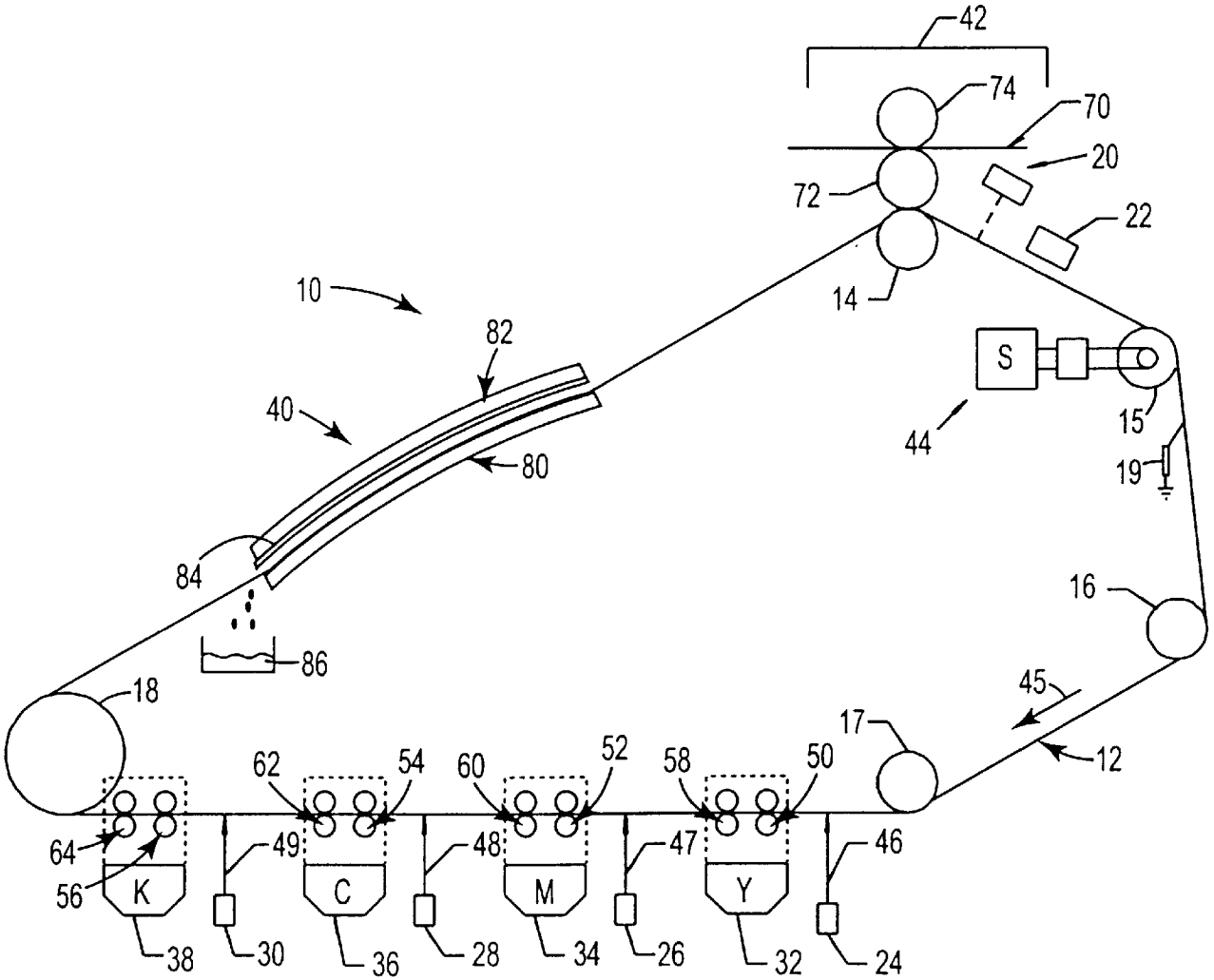
FIG. 1 is a schematic diagram illustrating one exemplary embodiment of an electrophotographic imaging system employing a gap drying system in accordance with the present invention.

The present invention provides an electrophotographic imaging system and method which employs a gap drying system. In FIG. 1, a schematic diagram conceptually illustrating an exemplary electrophotographic imaging system 10 employing a gap drying system in accordance with the present invention is generally shown. The gap drying system dries the photoconductor belt (i.e., removes excess carrier liquid (or other excess liquids or volitales) from the photoconductor belt after development of the image) without contacting the imaged side of the photoconductor belt and/or imaged region, or exposing the imaged region to undesirable air flow. Past problems associated with the saturation of a drying roll are eliminated. Further, carrier liquid (i.e., solvent) recovery is inherent in the gap drying system process. The need for a separate secondary carrier liquid recovery system (e.g., a condenser) is eliminated, reducing the overall cost of the electrophotographic imaging system.

The gap drying process is precisely controllable. In one exemplary embodiment wherein the gap drying system includes a cold condensing platen and a heated platen, the gap drying system is precisely controlled by adjusting the hot and cold platen temperatures, the position of the photoconductor belt with respect to the hot and cold platen, and the overall gap between the hot and cold plate. The amount of carrier liquid left on the photoconductor belt is adjustable to optimize the quality of image transfer. Contacting of the imaged belt surface by drying rolls is also eliminated.

Electrophotographic Imaging System Employing a Gap Drying System

In the exemplary embodiment of FIG. 1, imaging system 10 includes a photoconductor belt (i.e., an organic photoreceptor belt) 12 mounted about a plurality of rollers 14, 15, 16, 17, 18, a grounding brush 19, an erase station 20, a charging station 22, a plurality of laser scanners 24, 26, 28, 30, a plurality of development stations 32, 34, 36, 38, a gap drying system 40, a transfer station 42 and a belt steering system 44. The imaging system 10 forms a multi-color image in a single pass of photoconductor belt 12 around a continuous transport path (indicated by arrows 45). An imaging system capable of assembling a multi-color image in a single pass of a photoconductor is disclosed, for example, in co-pending U.S. patent application Ser. No. 08/948,437 Kellie et al., filed Oct. 10, 1997, and entitled "METHOD AND APPARATUS FOR PRODUCING A MULTI-COLORED IMAGE IN AN ELECTROPHOTOGRAPHIC SYSTEM". The entire content of the above-referenced patent application is incorporated herein by reference. Optionally, imaging system 10 may be a multi-pass electrophotographic imaging system.

In operation of system 10, photoconductor belt 12 is driven by roller 18 (i.e., roller 18 is coupled to a drive mechanism) to travel in a first direction along the continuous transport path 45. As photoconductor belt 12 moves along the transport path 45, erase station 20 uniformly discharges any charge remaining on the belt from a previous imaging operation. Ground brush 19 mechanically couples the ground plane of the photoconductor belt 12 to ground potential. As known in the art, in a dark environment, photoconductor belt 12 is an electrical insulator. When exposed to light by erase station 20 and at a correct light wavelength, photoconductor belt 12 becomes partially conductive such that the charge remaining on photoconductor belt 12 may be discharged to ground through ground brush 19. Photoconductor belt 12 then encounters charging station 22, which uniformly charges the photoconductor belt 12 to a predetermined level. The scanners 24, 26, 28, 30 selectively discharge an imaging region of the photoconductor belt 12 with laser beams 46, 47, 48, 49, respectively, to form latent electrostatic images. Each latent image is representative of one of a plurality of color separation images.

As shown in FIG. 1, each development station 32, 34, 36, 38 is disposed after one of scanners 24, 26, 28, 30, relative to the direction of movement along the transport path 45 of photoconductor belt 12. Each of development stations 32, 34, 36, 38 applies a developer liquid color toner having a color appropriate for the color separation image represented by the particular latent image formed by the preceding scanner 24, 26, 28, 30. In the example of FIG. 1, development stations 32, 34, 36, 38 apply yellow (Y), magenta (M), cyan (C), and a black developer (K), respectively, to photoconductor belt 12. A suitable developer is disclosed, for example, in U.S. Pat. No. 5,652,282 (issued Jul. 29, 1997 to Baker et al.) entitled "LIQUID INK USING A GEL ORGANOSOL". The entire content of the above-referenced patent application is incorporated herein by reference.

In the exemplary embodiment shown, each development station 32, 34, 36, 38 includes a developer roll 50, 52, 54, 56, followed by a liquid removal mechanism 58, 60, 62, 64. In one preferred embodiment shown, each liquid removal mechanism 58, 60, 62, 64 comprises a squeegee roller system. In one embodiment, at least one of the rollers has an outside absorbing layer such that excess carrier liquid may be transferred from the photoconductor surface and absorbed by the roller. Optionally, the rollers may not include an absorbing layer.

As photoconductor belt 12 passes development stations 32, 34, 36, 38, the desired liquid toner is applied to the photoconductor belt by the electrically biased rotating developer rolls 50, 52, 54, 56. The liquid toner present at each development station 32, 34, 36, 38 includes small color pigment particles dispersed in an insulating liquid (i.e., carrier liquid). The developed image for each color is created by electrostatic attraction of the charged pigment particles to the latent image.

Excess carrier liquid deposited on the photoconductor belt can cause staining and smudging of the latent image, and cause additional problems on the final image transfer process. As such, liquid removal mechanism 58, 60, 62, 64 (e.g., the squeegee roller systems shown) are positioned immediately after each developer roll 50, 52, 54, 56 to remove the excess carrier liquid (or other excess toner or volitales) deposited on the photoconductor belt 12 at each color development station 32, 34, 36, 38.

Additional drying of the photoconductor belt is necessary before the developed image reaches transfer station 42. As such, gap drying system 40 is positioned between the last development station 38 and transfer station 42. Gap drying system 40 further dries the latent image to remove all (or most of) the remaining carrier liquid such that the developed image on photoconductor belt 12 is transferable to output substrate 70 at transfer station 42.

A gap drying system used for removal of excess carrier liquid from the photoconductor belt 12 is illustrated generally at 40. The gap drying system 40 includes a carrier liquid vapor (i.e., solvent) recovery system which is inherent in the gap drying system process. The gap drying system generally includes a condensing surface spaced adjacent the photoconductor belt, facing the image region of the photoconductor belt. Means are provided for evaporating the excess carrier liquid from the photoconductor belt to create a vapor. The means for evaporating the excess carrier liquid from the photoconductor belt may comprise means for supplying energy to the photoconductor belt substrate without applied convection. In one preferred embodiment shown, the means for supplying energy to the photoconductor belt without applied convection comprises a heated platen. Means are provided for transporting and condensing the vapor on the condensing surface to create a condensate. Further, means are provided for removing the condensate from the condensing surface such that the condensate does not drop onto the developed image on the photoconductor belt.

In one preferred embodiment, a heated platen 80 is positioned below the photoconductor belt to supply energy used to evaporate the excess carrier liquid/solvent from the photoconductor belt. A chilled platen 82 having a condensing surface is spaced above the photoconductor belt 12 to condense the excess carrier liquid/solvent. Edge plates 84 are provided on each side of the chilled platen condensing surface to transport the condensed carrier liquid to the edge of the condensing surface. In one preferred embodiment, the chilled platen 82 condensing surface has grooves which use capillary forces to transport the condensed solvent to the sides of the chilled platen 82, for transferring the condensed solvent to the edge plates 84.

In one preferred embodiment, heated platen is 80 curved. Photoconductor belt 12 is dragged over the heated platen 80, efficiently transferring heat from heated platen 80 to photoconductor belt 12.

Heated platen 80 is optionally surface treated with functional coatings. Examples of functional coatings include: coatings to minimize mechanical wear or abrasion of belt 12 and/or platen 80 and coatings with selected electrical and/or selected thermal characteristics.

As photoconductor belt 12 is dragged over the heated platen 80, it assumes the shape of the curved heated platen. Curvature of the photoconductor belt 12 stiffens the photoconductor belt 12, adding support to the belt 12. Accordingly, the chilled platen 82 condensing surface is curved to correspond with the curvature of the photoconductor belt 12 surface, maintaining a uniform gap or space between the photoconductor belt 12 surface and the chilled platen 82 condensing surface.

Gap drying systems suitable for use in an electrophotographic imaging system in accordance with the present invention are taught in Huelsman et al. U.S. Pat. No. 5,581,905 and Huelsman et al. U.S. Pat. No. 5,694,701. Huelsman et al. '905 and Huelsman et al. '701 are incorporated herein by reference. A detailed description of one exemplary embodiment of gap drying system 40, including an integral carrier liquid recovery system is described in detail later in this specification.

The imaging region of photoconductor belt 12 containing the developed image next arrives at transfer station 42. Transfer station 42 includes an intermediate transfer roller 72 that forms a nip with the photoconductor belt 12 over belt roller 14 and a pressure roller 74 that forms a nip with the intermediate transfer roller 72. The developed image on photoconductor belt 12 transfers from the photoconductor belt surface to intermediate transfer roller 72 by selective adhesion. The pressure roller 74 serves to transfer the image onto intermediate transfer roller 72 to an output substrate 70 by application of pressure and/or heat to the output substrate 70. Output substrate 70 may comprise, for example, paper, film, plastic, fabric or metal. This process may be followed by a converting process which "converts" the output substrate 70 (containing the transferred images) into discreet units. Such discreet units can be packaged before being sold.

Figure 2:
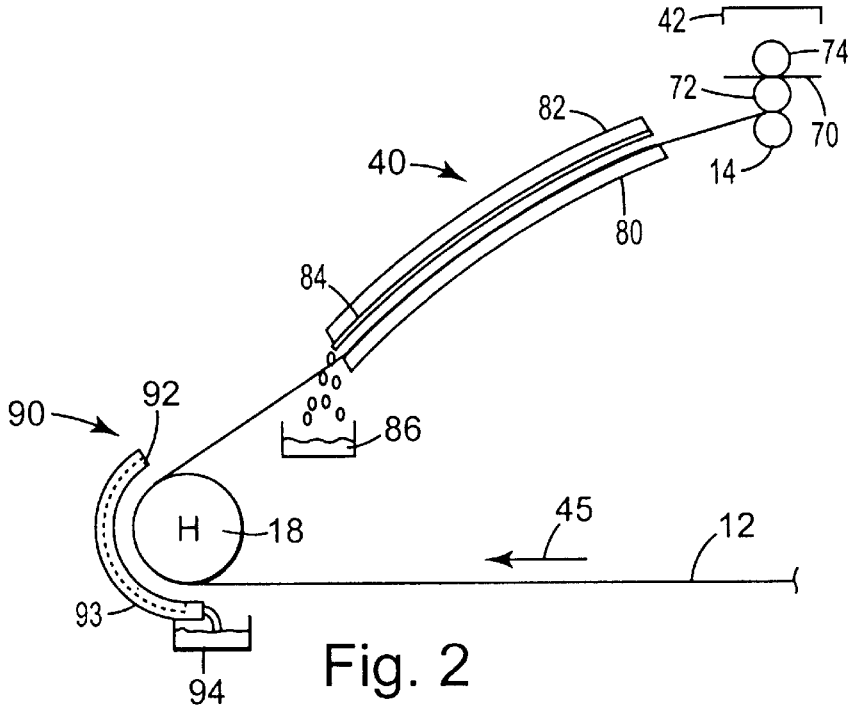
FIG. 2 is a partial schematic diagram illustrating another exemplary embodiment of an electrophotographic imaging system employing a gap drying system in accordance with the present invention.
Figure 3:
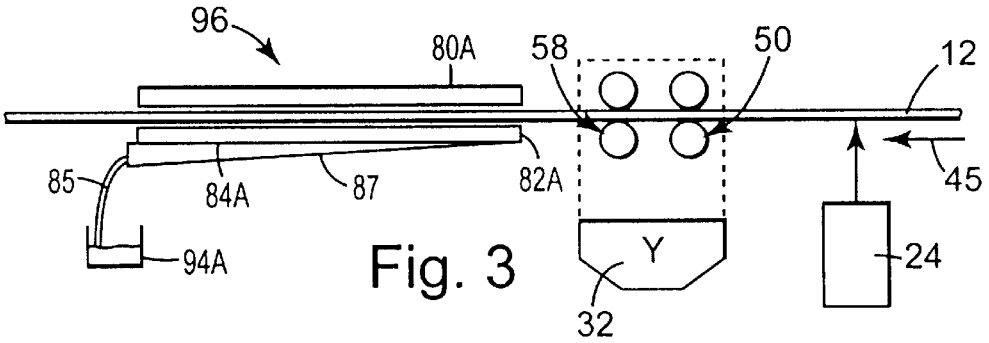
FIG. 3 is a partial schematic diagram illustrating another exemplary embodiment of an electrophotographic imaging system employing a gap drying system in accordance with the present invention.
Figure 4:
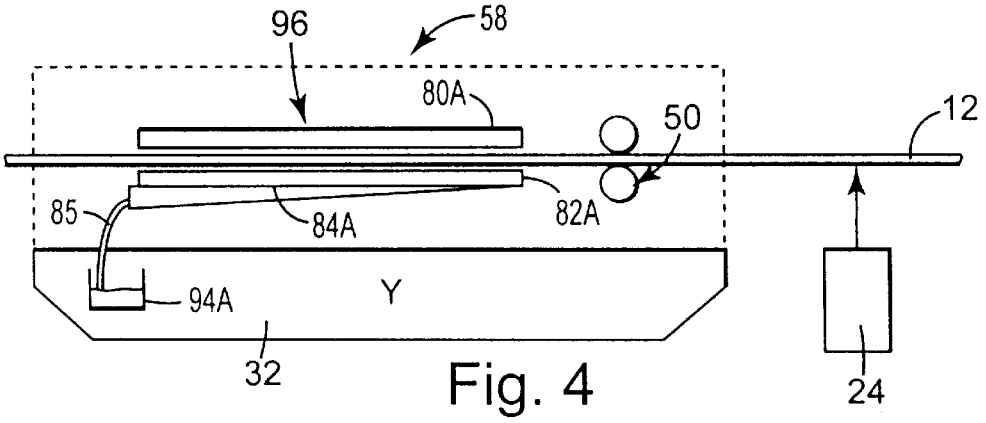
FIG. 4 is a partial schematic diagram illustrating another exemplary embodiment of an electrophotographic imaging system employing a gap drying system in accordance with the present invention.

In FIGS. 2–4, alternative exemplary embodiments of employing a gap drying system as part of an electrophotographic imaging system are illustrated. The gap drying system may be used as a primary means for removing excess toner/carrier liquid from the photoconductor belt 12, or may be utilized to supplement a primary drying/liquid removal system.

In FIG. 2, one alternative embodiment of employing a gap drying system in an electrophotographic imaging system is shown. A second gap drying system 90 is positioned adjacent the first gap drying system 40. The gap drying system 90 can be similar to the gap drying system 40 as described herein. In one particular embodiment shown, the gap drying system 90 is positioned about roller 18. As such, roller 18 is heated to provide sufficient energy to the photoconductor belt 12, without applied convection for evaporating the excess liquid from the photoconductor belt 12 to create a vapor. In this embodiment, the gap drying system 90 condensing surface includes a chilled cylindrical shell 92 which is mounted about the heated roller 18, wherein the condensing surface includes capillary grooves to collect the solvent evaporated in that region. The recovered solvent is transported using edge plates 93 and collected in solvent collector 94, which can be in communication with the gap drying system 40 solvent collector 86.

In FIG. 3, another alternative embodiment of the use of a gap drying system as part of a electrophotographic imaging system in accordance with the present invention is illustrated. In this embodiment, gap drying system 96 (indicated by heated platen 80A, condensing platen 82A and edge plate 84A) is positioned immediately following development station 32. As such, after a primary amount of excess carrier liquid is removed from the image region of the photoconductor belt 12 by liquid removal mechanism 58, gap drying system 96 provides a secondary system for removing remaining excess carrier liquid from the photoconductor belt 12 in addition to the carrier liquid removal mechanism (e.g., squeegee roller system) previously shown. As shown, trough 87 is slanted relative to generally horizontal belt 12, allowing for gravity flow of recovered excess carrier liquid 85 to collector 94A. Optionally, an edge plate 84A may not be required where condensing platen 82A is substantially horizontal. Referring to FIG. 4, it is contemplated that gap drying system 96 may be used as liquid removal mechanism 58, for removing excess carrier liquid from the photoconductor belt as part of development station 32. As such, gap drying system 96 may replace the previously shown liquid removal mechanism (e.g., squeegee roller system shown).

Gap Drying System

Figure 5:
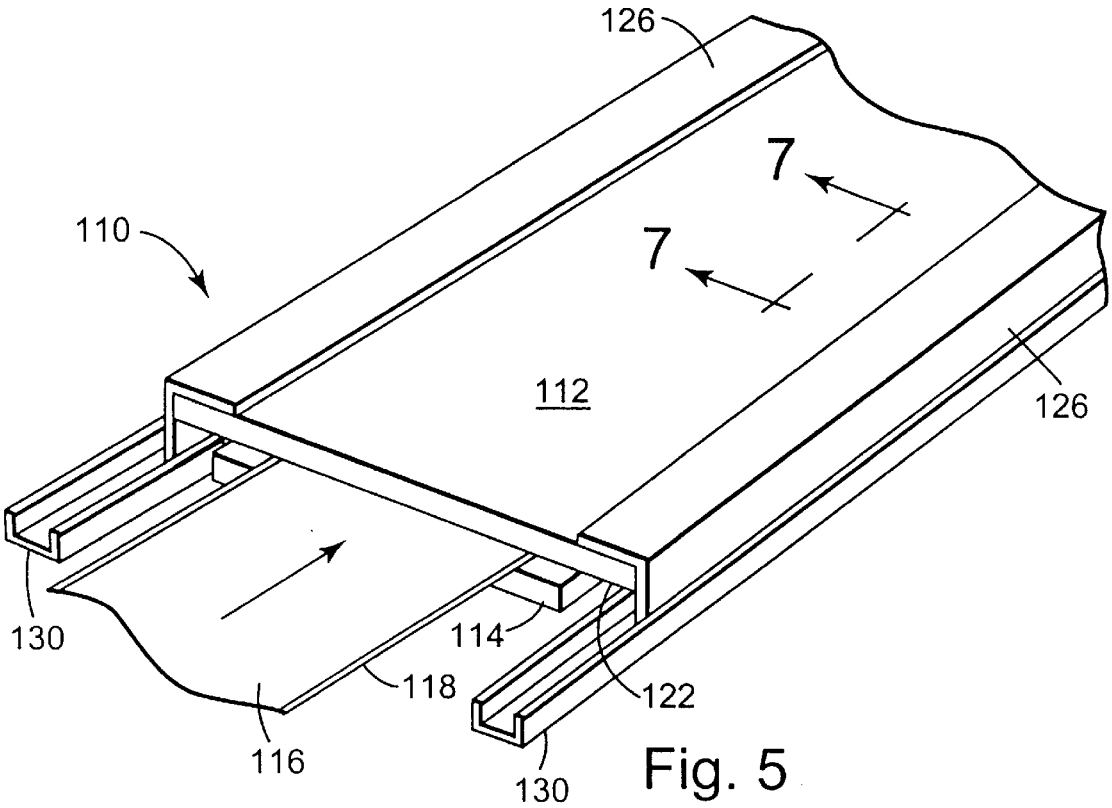
FIG. 5 is a perspective view of one exemplary embodiment of a gap drying system for use with an electrophotographic imaging system in accordance with the present invention.
Figure 6:
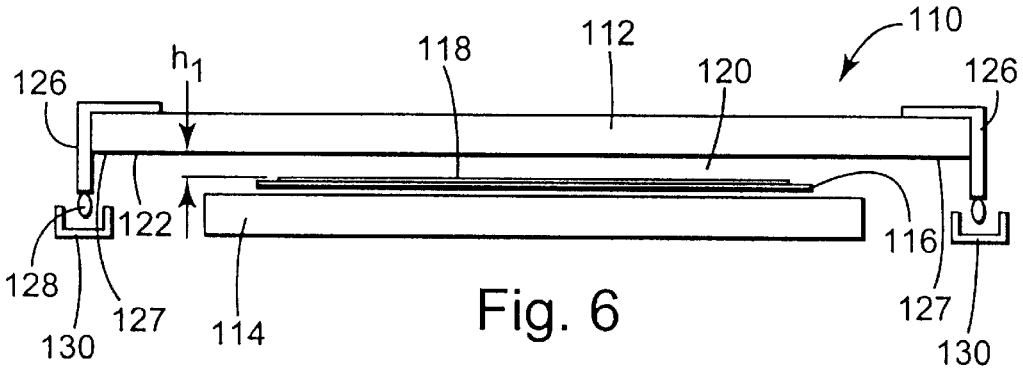
FIG. 6 is an end view of the gap drying apparatus of FIG. 5.

One preferred exemplary embodiment of a gap drying system for use in electrophotographic imaging systems is illustrated generally in FIG. 5 and FIG. 6. The gap drying system is illustrated generally at 110, and can be used as gap drying system 40, gap drying system 90 or gap drying system 96 previously described and shown herein. Gap drying system 110 is similar to the gap drying systems disclosed in the above-incorporated Huelsman et al. Patents '905 and '701. Gap drying system 110 includes a condensing platen 112 spaced from a heated platen 114. In one embodiment, condensing platen 112 is chilled. A moving photoconductor belt 116, having a liquid toned image 118, travels between condensing platen 112 and heated platen 114. Heated platen 114 is stationary within gap drying system 110. Heated platen 114 is disposed on the non-coated side of photoconductor belt 116, and there may be a small fluid clearance between photoconductor belt 116 and platen 114. Condensing platen 112 is disposed on the liquid toned image side of photoconductor belt 116. Condensing platen 112, which can be stationary or mobile, is placed above, but near the liquid toned surface. The arrangement of condensing platen 112 creates a small substantially planar gap above coated photoconductor belt 116. Heated platen 114 is preferably curved and contacts belt 116. Optionally, heated platen 114 and condensing platen 112 may be curved or flat (as shown).

Heated platen 114 eliminates the need for applied convection forces below photoconductor belt 116. Heated platen 114 transfers heat without convection through photoconductor belt 116 to liquid toned image 118 causing excess carrier liquid to evaporate from liquid toned image 118 to thereby dry the toned image. Heat is transferred dominantly by conduction, and slightly by radiation and convection, achieving high heat transfer rates. This evaporates the carrier liquid from toned image 118 on photoconductor belt 116. Evaporated carrier liquid from toned image 118 is transported (travels) across a gap 120 defined between photoconductor belt 116 and condensing platen 112 and condenses on a condensing surface 122 of condensing platen 112. Gap 120 has a height indicated by arrows $h_1$.

Heated platen 114 is optionally surface treated with functional coatings. Examples of functional coatings include: coatings to minimize mechanical wear or abrasion of web 116 and/or platen 114 and coatings with selected electrical and/or selected thermal characteristics.

Figure 7:
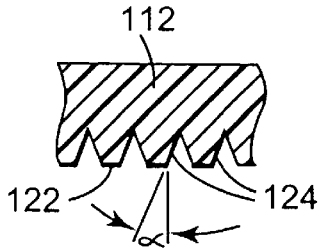
FIG. 7 is a partial cross-sectional view taken along line 7—7 of FIG. 5.

FIG. 7 illustrates a cross-sectional view of condensing platen 112. As illustrated, condensing surface 122 includes transverse open channels or grooves 124 which use capillary forces to move condensed liquid laterally to edge plates 126. In other embodiments, grooves 124 are longitudinal or in any other direction. Forming condensing surface 122 as a capillary surface facilitates removal of the condensed liquid.

When condensed carrier liquid reaches the end of grooves 124, it intersects with an interface interior corner 127 between edge plates 126 and condensing surface 122. Liquid collects at interface interior corner 127 and gravity overcomes capillary force and the liquid flows as a film or droplets 128 down the face of the edge plates 126, which can also have capillary surfaces. Edge plates 126 can be used with any condensing surface, not just one having grooves. Condensing droplets 128 fall from each edge plate 126 and are optionally collected in a collecting device, such as collecting device (or trough) 130. Collecting device 130 directs the condensed droplets to a container (not shown). Alternatively, the condensed liquid is not removed from condensing surface 122, but is prevented from returning to photoconductor belt 116. As illustrated, edge plates 126 are substantially perpendicular to condensing surface 122, but edge plates 126 can be at other angles with condensing surface 122. Edge plates 126 can have smooth, capillary, porous media, or other surfaces.

Heated platen 114 and condensing platen 112 optionally include internal passageways, such as channels. A heat transfer fluid is optionally heated by an external heating system (not shown) and circulated through the internal passageways in heated platen 114. The same or a different heat transfer fluid is optionally cooled by an external chiller and circulated through passageways in the condensing platen 112. There are many other suitable known mechanisms for heating platen 114 and cooling platen 112. For example, heat lamps may be used as a heating mechanism, and cooling of condensing platen 112 may be supplied by other liquid cooling means or cooling Peltier chips.

Figure 8:
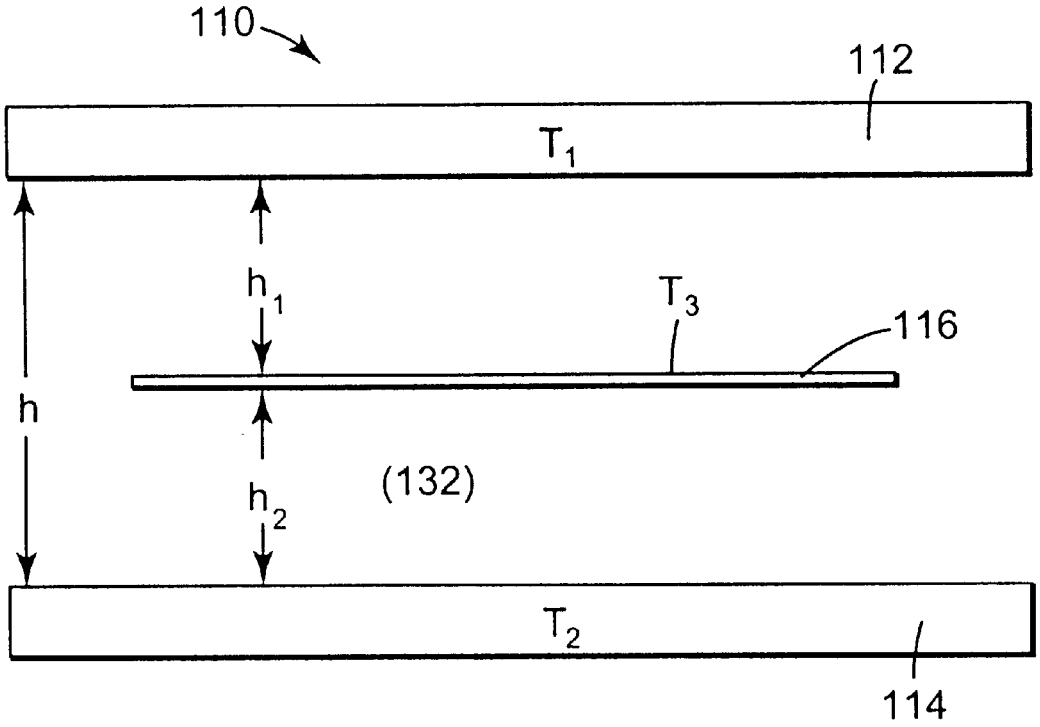
FIG. 8 is a schematic diagram side view illustrating process variables of the present invention.

FIG. 8 illustrates a schematic side view of gap drying system 110 to illustrate certain process variables. Condensing platen 112 is set to a temperature $T_1$, which can be above or below ambient temperature. Heated platen 114 is set to a temperature $T_2$, which can be above or below ambient temperature. The temperature of photoconductor 116 is defined by a varying temperature $T_3$. In the exemplary embodiment shown, coated photoconductor 116 is at a temperature $T_3$.

A distance between the bottom surface (condensing surface 122) of condensing platen 112 and the top surface of heated platen 114 is indicated by arrows h. A front gap distance between the bottom surface of condensing platen 112 and the top surface of the front (imaged) side of photoconductor belt 116 is indicated by arrows $h_1$. The back clearance distance between the bottom surface of the backside (non-coated side) of photoconductor belt 116 and the top surface of heated platen 114 is indicated by arrows $h_2$. Thus, the position of photoconductor belt 116 is defined by distances $h_1$ and $h_2$. In addition, distance h is equal to $h_1$ plus $h_2$ plus the thickness of coated photoconductor belt 116.

The performance of gap drying system 110 is precisely controllable by controlling process variable $T_1$, $T_2$, h, $h_1$ and $h_2$, and a desired drying of the imaged region/side of belt 116 is achieved. A uniform heat transfer coefficient throughout photoconductor belt 116 is obtained by supplying energy to the backside of photoconductor belt 116 by conduction through a thin air layer, indicated at 132, between heated platen 114 and moving photoconductor belt 116 (in the exemplary embodiment shown, heated platen 114 contacts photoconductor belt 116 and/or is dragged over photoconductor belt 116). The heat transfer coefficient to the backside of photoconductor belt 116 is the ratio of the thermal conductivity of the air to the thickness of air layer 132, which is indicated by arrows $h_2$. The energy flux (Q) to the belt is given by the following Equation I:

Equation I $$Q=k_{FLUID}(T_2-T_3)/h_2$$

Where, $k_{FLUID}$ is the heat conductivity of fluid (e.g., air);

$T_2$ is the heated platen temperature;

$T_3$ is the belt temperature; and $h_2$ is the distance between the bottom surface of the belt and the top surface of the heated platen.

As such, the performance of the gap drying system is precisely controllable to fit a specific electrophotographic imaging system by controlling certain process variables. In particular, as shown above, by controlling the temperature of the heated platen ($T_2$), the temperature of the condensing platen ($T_1$), and the relative distance of the photoconductor belt to the condensing platen and the heated platen ($h_1$, $h_2$) the process may be precisely controlled.

Experiments

Experiments were performed to quantify the amount of carrier (i.e., liquid solvent) liquid removed from the belt and recovered with a gap dryer at different operating conditions. The hot plate was 4 inches long and 11 inches wide. The chilled plate was 7 inches long and 12.5 inches wide. The capillary grooves machined on the condensing plate were 20×20 mils. The gap was approximately 0.0625 inches (0.159 cm).

Figure 9:
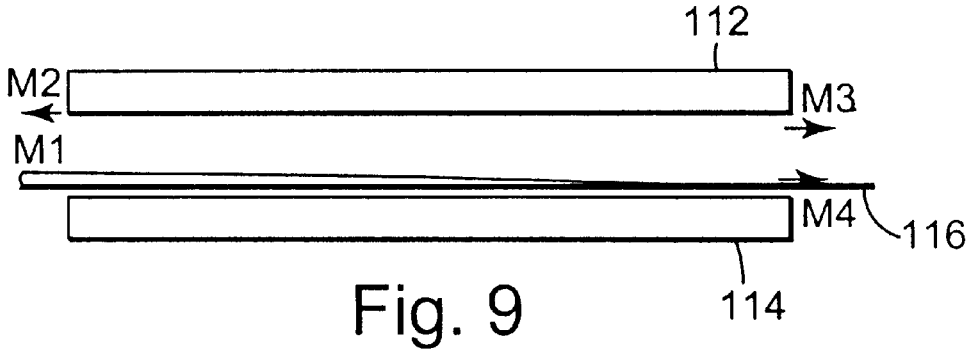
FIG. 9 is a schematic diagram illustrating inflow and outflow streams of carrier liquid in a gap drying system which may be utilized as part of an electrophotographic imaging system in accordance with the present invention.

Pure NORPAR™ solvent from Exxon Chemical Company was deposited on the photoconductor belt (an organic photoreceptor belt) by a developer roll. The bulk of the carrier liquid was removed by a squeegee roll, leaving a thin layer of pure carrier liquid on the belt. The different inflow and outflow streams of carrier liquid in the gap dryer are diagrammed in FIG. 9. M1 is the amount of solvent on the belt at the entrance of the gap dryer. If no evaporation occurs between the developer pod and the gap dryer, it is equal to the net flow rate out the developer pod, (i.e., the amount of carrier liquid deposited on the belt by the developer roll minus the amount removed by the squeegee roll). M2 is the amount of carrier liquid condensed by the chilled plate. M3 is the carrier liquid vapor convected out of the gap by the moving belt. It can be calculated assuming a Couette velocity profile of the air dragged by the belt motion inside the gap and assuming the air is saturated with carrier liquid at the exit of the gap dryer. M4 is the amount of solvent not evaporated from the belt. It is simply evaluated by M4=M1−(M2+M3).

Table 1 shows the values of M1, M2, M3 and M4 in grams for different drying conditions and belt speeds. For each set of conditions, solvent was collected for 30 minutes. The overall efficiency of the process is defined as the ratio between the amount of liquid solvent recovered M2 and the amount of solvent deposited on the OPR belt by the developer pod M1. It is also included in Table 1 for each set of conditions.

TABLE 1

| Belt Speed In/sec. | Residence Time sec. | Hot Temp ° C. | Cold Temp ° C. | M1 g | M2 g | M3 g | M4 g | Efficiency M2/M1 % |
|---|---|---|---|---|---|---|---|---|
| 1.67 | 2.4 | 95 | 13 | 11.01 | 9.18 | .77 | 1.06 | 83.4 |
| 1.67 | 2.4 | 90 | 13 | 11.11 | 8.78 | .7 | 1.63 | 79.0 |
| 1.67 | 2.4 | 85 | 13 | 11.18 | 8.52 | .61 | 2.05 | 76.2 |
| 3 | 1.3 | 90 | 13 | 19.7 | 11.7 | 1.27 | 6.7 | 59.4 |
| 3 | 1.3 | 105 | 13 | 21.0 | 16.0 | 1.66 | 3.4 | 76.0 |

The above experiment results met or exceeded the performance characteristics of known drying systems used as part of an electrophotographic imaging process. Yet, an electrophotographic imaging system which employs a gap drying system (having an inherent carrier liquid recover system) is precisely controllable, does not require an additional carrier liquid recovery/condensing unit, and does not contact the imaged region of the photoconductor belt. Carrier liquid recovery efficiency of the present invention is extremely high since there is a high concentration of vapor due to the closeness of the belt surface to the condensing surface.

The imaging process utilizing a gap drying system in accordance with the present invention may be extended to other types of imaging systems. Further, the excess carrier liquid recovered using the gap drying system may be reused in the electrophotographic imaging system. For example, the recovered liquid may be reused to dilute toner used in the imaging system. Numerous characteristics and advantages of the invention have been set forth in the foregoing description. It will be understood, of course, that this disclosure is, and in many respects, only illustrative. Changes can be made in details, particularly in matters of shape, size and arrangement of parts without exceeding the scope of the invention. The invention scope is defined in the language in which the appended claims are expressed.

What is claimed is:

1. An electrophotographic imaging system comprising:

a photoconductor belt including a first major surface and a second major surface;

a mechanism for moving the photoconductor belt in a first direction along a transport path;

a scanner mechanism positioned along the transport path for scanning a laser beam across the photoconductor belt based on image data to form a latent image on the photoconductor belt;

a development station positioned along the transport path, including a mechanism for applying a toner to the first major surface of the photoconductor belt, the toner including a carrier liquid; and a gap drying system operably positioned along the transport path, the gap drying system including a condensing surface spaced adjacent the photoconductor belt, facing the first major surface of the photoconductor belt, and means for evaporating excess carrier liquid from the photoconductor to create a vapor, facing the second major surface of the photoconductor belt, wherein the gap drying system removes excess carrier liquid from the photoconductor belt.

2. The system of claim 1, the gap drying system further comprising means for recovering carrier liquid, wherein the means for recovering carrier liquid is integral the gap drying system.

3. The system of claim 1, the development station further comprising a carrier liquid removal mechanism, wherein the carrier liquid removal mechanism removes excess carrier liquid from the photoconductor belt.

4. The system of claim 3, wherein the carrier liquid removal mechanism includes a squeegee.

5. The system of claim 3, wherein the carrier liquid removal mechanism includes a drying roll.

6. The system of claim 3, wherein the carrier liquid removal mechanism includes a development station gap drying system.

7. The system of claim 1, further comprising:

a carrier liquid collector mechanism in fluid communication with the gap drying system.

8. The system of claim 1, further comprising:

a second gap drying system, wherein the second gap drying system removes excess carrier liquid from the photoconductor belt.

9. The system of claim 1, wherein the gap drying system further comprises:

means for transporting the vapor to the condensing surface without requiring applied convection;

means for condensing the vapor on the condensing surface to create a condensate; and means for removing the condensate from the condensing surface such that the condensate does not drop onto the first major surface.

10. The system of claim 9, wherein the means for evaporating the excess carrier liquid from the photoconductor belt comprises means for supplying energy to the substrate without applied convection.

11. An electrophotographic imaging system comprising:

a photoconductor belt;

a mechanism for moving the photoconductor belt in a first direction along a transport path;

a scanner mechanism positioned along the transport path for scanning a laser beam across the photoconductor belt based on image data to form a latent image on the photoconductor belt;

a development station positioned along the transport path, including a mechanism for applying a toner to a the first major surface of the photoconductor belt, the toner including a carrier liquid; and a gap drying system operably positioned along the transport path, wherein the gap drying system removes excess carrier liquid from the photoconductor belt, wherein the gap drying system further comprises a condensing surface spaced adjacent the photoconductor belt, facing the first major surface of the photoconductor belt; means for evaporating the excess carrier liquid from the photoconductor belt to create a vapor; means for transporting the vapor to the condensing surface without requiring applied convection; means for condensing the vapor on the condensing surface to create a condensate; means for removing the condensate from the condensing surface such that the condensate does not drop onto the first major surface; and a condensing platen located adjacent the first major surface of the photoconductor belt, wherein the condensing surface is part of the condensing platen, and a heated platen facing a second major surface of the photoconductor belt, wherein the heated platen is part of the means for evaporating the excess carrier liquid from the photoconductor belt.

12. A drying and solvent recovery system for removing excess carrier liquid from a first major surface of a photoreceptor, the photoreceptor including a second major surface opposite the first major surface, the drying and solvent recover system comprising:

a first gap drying system including a condensing surface facing the first major surface of the photoreceptor, means for evaporating the excess carrier liquid to create a vapor facing the second major surface of the photoreceptor, means for transporting the vapor to the condensing surface without requiring applied convection, and means for condensing the vapor on the condensing surface to create a condensate, and means for removing the condensate from the condensing surface to a collection location.

13. The system of claim 12, further comprising a carrier liquid removal mechanism positioned at a development station.

14. The system of claim 13, wherein the carrier liquid removal mechanism includes a squeegee roller which contacts the first major surface.

15. The system of claim 13, wherein the carrier liquid removal mechanism is heated.

16. The system of claim 15, wherein the carrier liquid removal mechanism contacts the first major surface.

17. The system of claim 13, wherein the carrier liquid removal mechanism includes at least one heated roller which contacts a second major surface.

18. The system of claim 12, further comprising a second gap drying system similar to the first gap drying system.

19. A drying and solvent recovery system for removing excess carrier liquid from a first major surface of a photoreceptor comprising:

a first gap drying system including a condensing surface facing the first major surface of the photoreceptor, means for evaporating the excess carrier liquid to create a vapor, means for transporting the vapor to the condensing surface without requiring applied convection, and means for condensing the vapor on the condensing surface to create a condensate, and means for removing the condensate from the condensing surface to a collection location, the first gap drying system including a condensing platen located adjacent the first major surface of the photoconductor belt, wherein the condensing surface is part of the condensing platen, and a heated platen facing a second major surface of the photoconductor belt, wherein the heated platen is part of the means for evaporating the excess carrier liquid from the photoconductor belt.

20. The system of claim 19, wherein the photoconductor belt is moving, and wherein the means for removing moves the condensate in a direction substantially transverse to the direction of movement of the photoconductor belt.

21. A method of forming an image on a photoconductor belt using an electrophotographic imaging system, the method comprising the steps of:

providing a photoconductor belt having a first major surface and a second major surface;

moving the photoconductor belt in a first direction along a continuous transport path;

scanning a laser beam across the photoconductor belt based on image data to form a latent image on the photoconductor belt;

developing the latent image on the photoconductor belt, including applying a toner to a first major surface of the photoconductor belt, the toner including a carrier liquid;

locating a gap drying system along the photoconductor belt, including the steps of locating a condensing surface facing the first major surface of the photoconductor belt and locating an evaporation mechanism facing the second major surface of the photoconductor belt; and removing excess carrier liquid from the photoconductor belt using the gap drying system.

22. The method of claim 21, wherein the step of removing the excess carrier liquid from the photoconductor belt further comprises the step of using the gap drying system to recover and reuse the carrier liquid.

23. The method of claim 21, further comprising the step of:

providing a carrier liquid recovery system; and removing excess carrier liquid from the photoconductor belt using the carrier liquid recovery system after applying toner to the first major surface of the photoconductor belt.

24. The method of claim 21, wherein the step of providing a liquid recovery system further comprises the step of positioning a squeegee roller adjacent the photoconductor belt is loaded against the first major surface.

25. An electrophotographic imaging system comprising:

a photoconductor belt including a first major surface and second major surface;

a mechanism for moving the photoconductor belt in a first direction along a transport path;

a scanner mechanism positioned along the transport path for scanning a laser beam across the photoconductor belt based on image data to form a latent image on the photoconductor belt;

a development station positioned along the transport path, including a mechanism for applying a toner to the first major surface of the photoconductor belt, the toner including a carrier liquid; and a gap drying system operably positioned along the transport path, the gap drying system including a chilled condensing surface spaced adjacent the photoconductor belt facing the first major surface of the photoconductor belt, and an evaporation mechanism facing the second major surface of the photoconductor belt in operational alignment with the chilled condensing surface, wherein the gap drying system operates to remove excess carrier liquid from the photoconductor belt.

26. The system of claim 25, wherein the evaporation mechanism is heated.

27. The system of claim 25, wherein the gap drying system further includes a mechanism for controlling the temperature of the chilled condensing surface.

28. The system of claim 25, wherein the gap drying system further includes a mechanism for controlling the temperature of the evaporation mechanism.

29. An imaging system comprising:

an imaging substrate including a first major surface and a second major surface;

a mechanism for moving the imaging substrate in a first direction along a transport path;

an imaging mechanism operably positioned along the transport path;

a development station positioned along the transport path, including a mechanism for applying a liquid toner to the first major surface of the imaging substrate; and a gap drying system operably positioned along the transport path, the gap drying system including a condensing surface spaced adjacent the imaging substrate, facing the first major surface of the imaging substrate, and a mechanism for evaporating excess liquid toner from the imaging substrate to create a vapor, facing the second major surface of the imaging substrate, wherein the gap drying system removes excess liquid toner from the imaging substrate.

30. The system of claim 29, the gap drying system further comprising means for recovering the excess liquid toner, wherein the means for recovering the excess liquid toner is integral the gap drying system.

31. The system of claim 29, wherein the mechanism for evaporating excess liquid toner from the imaging substrate includes a heated platen.

32. The system of claim 29, wherein the gap drying system further includes a mechanism for controlling the temperature of the chilled condensing surface.

33. The system of claim 29, wherein the gap drying system further includes a mechanism for controlling the temperature of the evaporation mechanism.

34. The system of claim 29, wherein the liquid toner includes a carrier liquid, and wherein the excess liquid toner includes excess carrier liquid.

* * * * *